US010354483B2

(12) United States Patent
Thacker et al.

(10) Patent No.: US 10,354,483 B2
(45) Date of Patent: Jul. 16, 2019

(54) GAMING SYSTEMS AND METHODS FOR USE IN CREATING RANDOM REWARDS

(71) Applicant: Video Gaming Technologies, Inc., Brentwood, TN (US)

(72) Inventors: Christopher John Thacker, Earlysville, VA (US); Daniel William Milligan, Palmyra, VA (US); Stephen Wade Brooks, Lynchburg, VA (US)

(73) Assignee: VIDEO GAMING TECHNOLOGIES, INC., Brentwood, TN (US)

( * ) Notice: Subject to any disclaimer, the term of this patent is extended or adjusted under 35 U.S.C. 154(b) by 0 days.

(21) Appl. No.: 15/274,753

(22) Filed: Sep. 23, 2016

(65) Prior Publication Data

US 2017/0011587 A1 Jan. 12, 2017

Related U.S. Application Data

(63) Continuation of application No. 13/335,049, filed on Dec. 22, 2011, now abandoned.

(51) Int. Cl.
*G07F 17/32* (2006.01)

(52) U.S. Cl.
CPC ..... *G07F 17/3225* (2013.01); *G07F 17/3209* (2013.01); *G07F 17/3211* (2013.01); *G07F 17/3241* (2013.01); *G07F 17/3246* (2013.01); *G07F 17/3251* (2013.01)

(58) Field of Classification Search
USPC ..... 463/42
See application file for complete search history.

(56) References Cited

U.S. PATENT DOCUMENTS

| | | | |
|---|---|---|---|
| 6,077,162 | A | 6/2000 | Weiss |
| 6,206,782 | B1 | 3/2001 | Walker et al. |
| 6,503,146 | B2 | 1/2003 | Walker et al. |
| 6,776,715 | B2 | 8/2004 | Price |
| 7,364,510 | B2 | 4/2008 | Walker et al. |
| 7,387,571 | B2 | 6/2008 | Walker et al. |
| 7,713,124 | B2 | 5/2010 | Cuddy et al. |
| 7,785,194 | B2 | 8/2010 | Schneider et al. |
| 7,883,413 | B2 | 2/2011 | Paulsen |
| 8,047,909 | B2 | 11/2011 | Walker et al. |
| 8,328,635 | B2 | 12/2012 | Oosthoek |
| 8,360,864 | B2 | 1/2013 | Dickerson |

(Continued)

FOREIGN PATENT DOCUMENTS

WO 2010105088 A1 9/2010

OTHER PUBLICATIONS

Olympic Entertainment Group, Terminator information available at http://www.olympic-casino.com/index.php?id=24360&b=1c tpl=1094 (last viewed Dec. 22, 2011).

*Primary Examiner* — Tramar Y Harper
(74) *Attorney, Agent, or Firm* — Armstrong Teasdale LLP

(57) ABSTRACT

Servers and method for use in creating a random reward are disclosed. One exemplary method includes receiving a request for a random reward from an organizer, establishing a random reward in response to the request, transmitting a credential associated with the random reward to a player, and crediting gaming activity associated with the credential to the random reward. Access to the random reward is limited to players presenting the credential.

26 Claims, 3 Drawing Sheets

(56) References Cited

U.S. PATENT DOCUMENTS

| | | | | |
|---|---|---|---|---|
| 8,740,696 | B2 | 6/2014 | Dickerson | |
| 2006/0089194 | A1* | 4/2006 | Joshi | G07F 17/32 463/25 |
| 2007/0026941 | A1 | 2/2007 | Block et al. | |
| 2007/0054733 | A1* | 3/2007 | Baerlocher | G07F 17/32 463/27 |
| 2007/0060292 | A1* | 3/2007 | Peterson | G07F 17/32 463/20 |
| 2007/0060319 | A1 | 3/2007 | Block et al. | |
| 2008/0019353 | A1* | 1/2008 | Foote | H04L 12/1822 370/352 |
| 2008/0064492 | A1 | 3/2008 | Oosthoek | |
| 2009/0117979 | A1* | 5/2009 | Decasa, Jr. | G07F 17/32 463/20 |
| 2009/0124364 | A1* | 5/2009 | Cuddy | G07F 17/3258 463/27 |
| 2009/0176564 | A1 | 7/2009 | Herrmann et al. | |
| 2010/0019453 | A1 | 1/2010 | Oakes et al. | |
| 2010/0048295 | A1 | 2/2010 | Okada | |
| 2010/0062840 | A1 | 3/2010 | Herrmann | |
| 2010/0203963 | A1 | 8/2010 | Allen et al. | |
| 2010/0311496 | A1 | 12/2010 | Taylor et al. | |
| 2011/0028207 | A1 | 2/2011 | Gagner et al. | |
| 2012/0202587 | A1 | 8/2012 | Allen et al. | |
| 2012/0309541 | A1* | 12/2012 | Kofman | H04L 67/38 463/42 |
| 2013/0035153 | A1* | 2/2013 | Young | G07F 17/3258 463/20 |
| 2013/0237312 | A1* | 9/2013 | Palmisano | G07F 17/3227 463/26 |

* cited by examiner

GAMING SYSTEMS AND METHODS FOR USE IN CREATING RANDOM REWARDS

CROSS REFERENCE TO RELATED APPLICATIONS

This application is a continuation application of application Ser. No. 13/335,049 filed Dec. 22, 2011, which is hereby incorporated by reference in its entirety.

BACKGROUND OF THE INVENTION

The embodiments described herein relate generally to gaming systems methods and, more particularly, to gaming systems methods for use in creating random rewards.

At least some known gaming machines provide a primary game and a secondary game. For example, a secondary game may include free plays that are associated with a probability of a payout and do not require a player to deposit money or credits to the gaming machine. A secondary game may be triggered by a condition, such as a particular combination of symbols associated with a primary play outcome in the primary game. A number of different secondary games are known. Secondary jackpots are generally used by gaming entities to encourage additional play from one or more players. An example of a secondary game is a progressive jackpot, which incremental grows as players continue to bet at slot machines linked to the progressive jackpot. The progressive jackpots are generally known to being geographically limited to a casino, not guaranteed to payout, and open to any player within the casino.

BRIEF DESCRIPTION OF THE INVENTION

In one aspect, a method for use in creating a random reward is disclosed. The method includes receiving a request for a random reward from an organizer, establishing a random reward in response to the request, transmitting a credential associated with the random reward to a player, and crediting gaming activity associated with the credential to the random reward. Access to the random reward is limited to players presenting the credential.

In another aspect, a gaming system is disclosed. The gaming system includes a gaming machine and a gaming server coupled to the gaming machine. The gaming server is configured to receive a request for a random reward from an organizer, establish a random reward in response to the request, transmitting a credential associated with the random reward to a player, and credit gaming activity associated with the credential to the random reward. Access to the random reward is limited to players presenting the credential.

In yet another aspect, a gaming server for use in creating a random reward accessible to a group of players is disclosed. The gaming server includes a memory device configured to store multiple credentials associated with a random reward and a processor coupled to the memory device. The processor is configured to establish the random reward in response to a request for the random reward from an organizer, transmit the multiple credential associated with the random reward from the memory device to multiple players, and credit gaming activity to the random reward when at least one of the multiple credentials is associated with the gaming activity. Access to the random reward is limited to players presenting one of the multiple credential In another aspect, one or more non-transitory computer-readable storage media having computer-executable instructions embodied thereon is disclosed. When executed by at least one processor, the computer-executable instructions cause the processor to receive a request for a random reward from an organizer, establish a random reward in response to the request, transmitting a credential associated with the random reward to a player, and credit gaming activity associated with the credential to the random reward. Access to the random reward is limited to players presenting the credential.

DETAILED DESCRIPTION OF THE INVENTION

Exemplary embodiments of systems and methods for use in creating random rewards are described herein. Such embodiments may enhance entertainment aspects of various gaming activities by providing chances to win a secondary game associated with the gaming activities and/or by providing incentives to engage in gaming activities. One such secondary game may include a random reward, which is setup by an organizer and private to a group of players.

Exemplary technical effects of systems and methods described herein include at least one of: (a) receiving a request for a random reward from an organizer, (b) establishing a random reward in response to the request, (c) transmitting a credential associated with the random reward to a player, and (d) crediting gaming activity associated with the at least one credential to trigger the random reward. Access to the random reward is limited to players presenting the credential.

Figure 1:
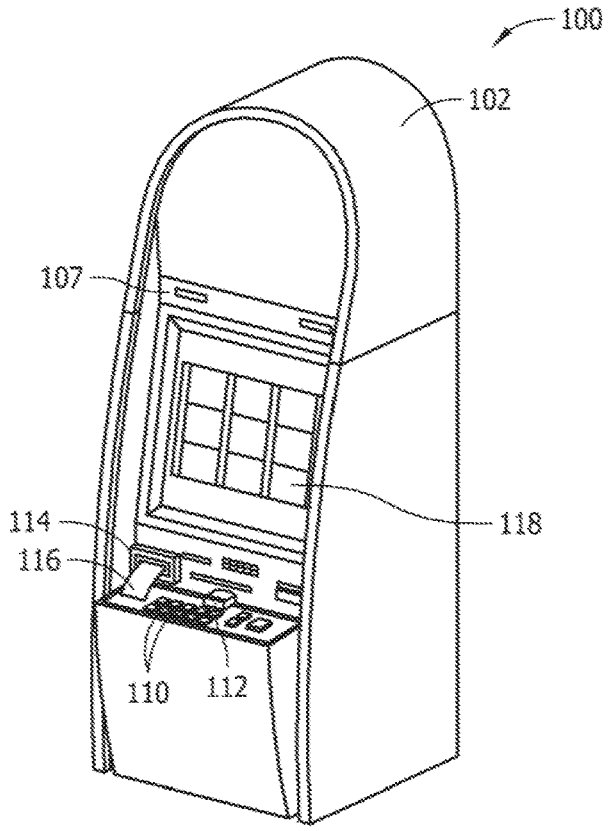
FIG. 1 is a perspective view of an exemplary gaming machine.

FIG. 1 is a schematic diagram of an exemplary gaming machine 100, which may be any type of gaming machine, and may include different structures than those shown in FIG. 1. In various embodiments, gaming machine 100 includes, without limitation, video bingo machines, video poker machines, video slot machines, and/or other similar gaming machines that implement other recognized casino games.

Figure 2:
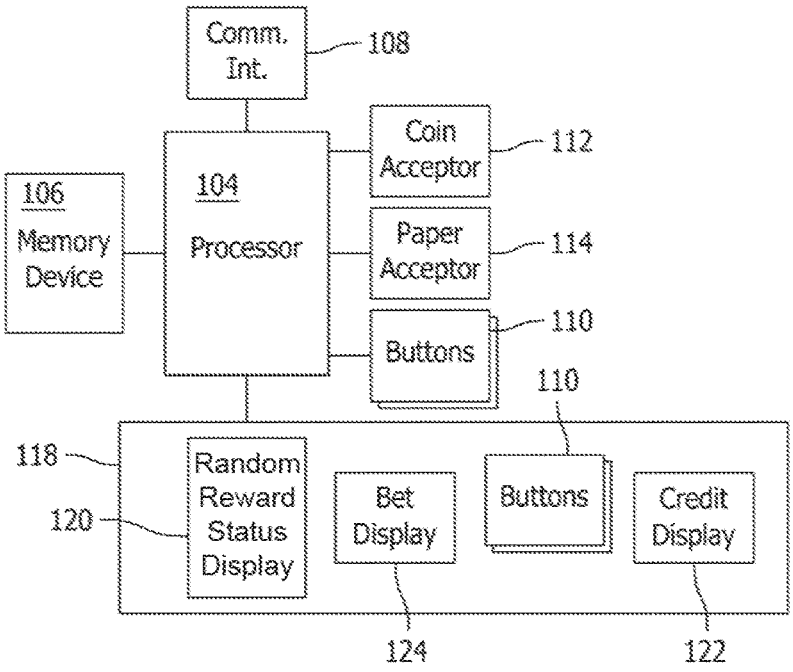
FIG. 2 is a block diagram of the exemplary gaming machine shown in FIG. 1.

In the exemplary embodiment, gaming machine 100 includes a cabinet 102 configured to at least partially enclose and/or support a plurality of components, such as a processor, peripheral devices, presentation devices, and player interaction devices. FIG. 2 illustrates a block diagram of at least a portion of the components of gaming machine 100. As shown, gaming machine 100 includes a processor 104 communicatively coupled to a memory device 106. Processor 104 and memory device 106 are enclosed within cabinet 102 (shown in FIG. 1). Gaming machine 100 is configurable and/or programmable to perform one or more operations described herein by programming processor 104. For example, processor 104 may be programmed by encoding an operation as one or more executable instructions and providing the executable instructions in memory device 106. The term processor, as used herein, refers to central processing units, microprocessors, microcontrollers, reduced instruction set circuits (RISC), application specific integrated circuits (ASIC), logic circuits, and any other circuit or processor capable of executing instructions. Processor 104 may be programmed to perform, alone or in combination, any of the processes, methods or functions described herein.

Memory device 106 stores instructions, executable by processor 104, for controlling gaming machine 100. For example, memory device 106 stores data such as a status of the random reward, player identifying information, random or pseudo-random number generation software, pay table data, and/or other information or applicable game rules that relate to game play on gaming machine 100. Memory device 106 may include one or more forms of memory. For example, memory device 106 may include, without limitation, random access memory (RAM), read-only memory (ROM), flash memory, and/or electrically erasable programmable read-only memory (EEPROM). In some embodiments, other suitable magnetic, optical, and/or semiconductor-based memory may be included in memory device 106 by itself or in combination.

Gaming machine 100 includes a communication interface 108 to enable communication with one or more other gaming machines 100 and/or a gaming server (as described below), directly and/or through a network.

Gaming machine 100 includes a plurality of switches and/or buttons 110 that are coupled to a front 107 of cabinet 102. Buttons 110 may be used to start play of a primary or secondary game. One button 110 may be a "Bet One" button that enables the player to place a bet or to increase a bet. Another button 110 may be a "Bet Max" button that enables the player to bet a maximum permitted wager. Yet another button 110 may be a "Cash Out" button that enables the player to receive a token payment, a money payment or other suitable form of payment, such as a ticket or voucher, which corresponds to a number of remaining credits.

In the exemplary embodiment, gaming machine 100 includes a coin acceptor 112 for accepting coins and/or tokens, and a paper acceptor 114 for accepting and/or validating cash bills, coupons, tickets, and/or vouchers 116. Paper acceptor 114 may also be capable of printing tickets or vouchers 116. Furthermore, in some embodiments, paper acceptor 114 includes a card reader for use with credit cards, debit cards, identification cards, reward cards and/or smart cards. The cards accepted by paper acceptor 114 may include a magnetic strip and/or a preprogrammed microchip that includes a player's identification, one or more credentials, credit totals, and any other relevant information that may be used.

Moreover, in the exemplary embodiment, gaming machine 100 includes one or more presentation devices 118. Presentation devices 118 are mounted to and/or at least partially within cabinet 102 and controlled by processor 104, and may include a primary presentation device for displaying a primary game and a secondary presentation device for displaying a secondary or bonus game. Presentation devices 118 may include, without limitation, a plasma display, a liquid crystal display (LCD), a display based on light emitting diodes (LEDs), organic light emitting diodes (OLEDs), polymer light emitting diodes (PLEDs), and/or surface-conduction electron emitters (SEDs), a speaker, an alarm, and/or any other device capable of presenting information to a user. In the exemplary embodiment, presentation device 118 is a touch screen device, suitable to display information to a player and receive inputs from the player. In at least one embodiment, as shown in FIG. 2, one or more of buttons 110 may be incorporated into the touch screen device 118.

Presentation device 118 is used to display one or more game images, symbols, a credit status, a gaming status and/or indicia such as a visual representation or exhibition of movement of an object such as a mechanical, virtual, or video reel, dynamic lighting, video images, and the like. Additionally, or alternatively, presentation device 118 displays images and indicia using mechanical means. For example, presentation device 118 may include an electromechanical device, such as one or more rotatable reels, to display a plurality of game or other suitable images, symbols, or indicia.

In an exemplary embodiment, gaming machine 100 includes a random reward status display 120, which is provided to display a status of the random reward and/or a status of one or more other players participating in the random reward. Further, gaming machine 100 includes a credit display 122, which displays a player's current number of credits, cash, account balance, or equivalent. Additionally, gaming machine 100 also includes a bet display 124 which displays a player's amount wagered. Random reward status display 120, credit display 122 and/or bet display 124 may be standalone displays independent of presentation device 118, or incorporated into presentation device 118.

In one embodiment, gaming machine 100 randomly generates game outcomes using probability data. For example, each game outcome is associated with one or more probability values that are used by gaming machine 100 to determine the game output to be displayed. Such a random calculation may be provided by a random number generator, such as a true random number generator (RNG), a pseudo-random number generator (PNG), or any other suitable randomization process. Moreover, gaming machines 100 may be terminal-based machines, wherein the actual games, including random number generation and/or outcome determination, are performed at a gaming server. In such an embodiment, gaming machine 100 displays results of the game via presentation device 118 (shown in FIGS. 1 and 2).

Figure 3:
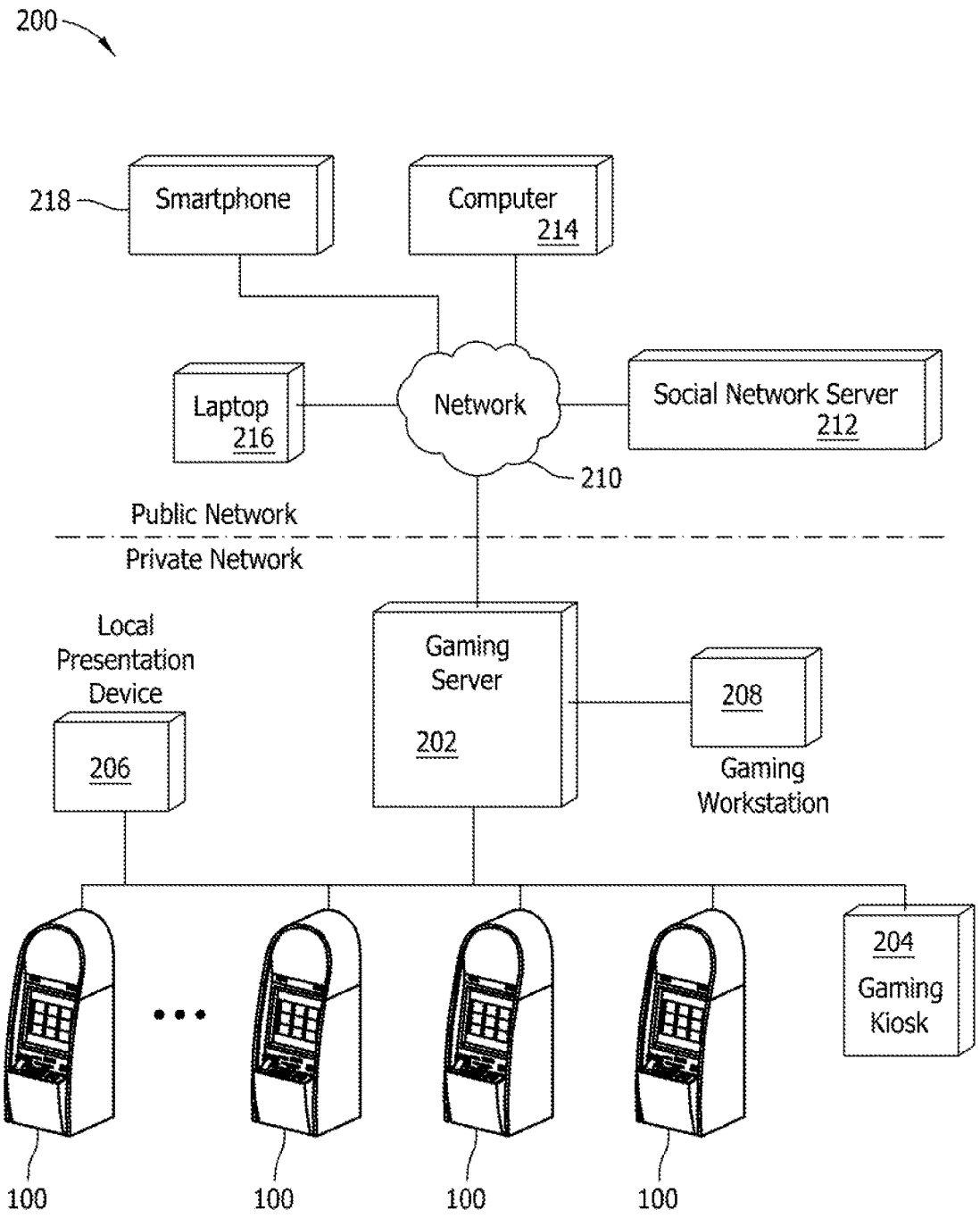
FIG. 3 is a diagram of an exemplary gaming system network.

FIG. 3 illustrates an exemplary gaming system 200. In the exemplary embodiment, gaming system 200 includes a gaming server 202 coupled to a plurality of gaming machines 100. Gaming server 202 may perform a plurality of functions including, for example, game outcome generation, player tracking functions, and/or accounting functions. Gaming server 202 may include one server or a plurality of servers that together or separately perform one or more of functions described herein. Further, gaming system 200 includes a gaming kiosk 204, which is usable to, without limitation, print coupons, redeem coupons, cash-in tokens, view bonus statuses, enter player information, etc. Specifically, in this exemplary embodiment, gaming kiosk 204 may be used by a player to organize a random reward and/or redeem a credential to enter a random reward, as described in more detail below.

In the exemplary embodiment, gaming system 200 includes a local presentation device 206, which may be disposed at one or more locations throughout a gaming location, such as a casino. In one example, local presentation device 206 may be disposed above a group of gaming machines 100, proximate to gaming kiosk 204, and/or other locations viewable by one or more players. In one embodiment, local presentation device 206 is mounted proximate to a plurality of gaming machines 100 to display status information related to one or more random rewards. In such an embodiment, local presentation device 206 may also display a leader-board of players of a random reward and/or real-time or near real-time crediting of gaming activity to a random reward, as a whole and/or per player. Gaming system 200 further includes a gaming workstation 208, which is often utilized by one or more employees of a gaming entity, such as a casino. Gaming workstation 208 may provide an employee access to gaming server 202 to enter identifying information about a player, such as name, contact information, rewards information, etc. In several embodiments, gaming workstation 208 may be used by at least one gaming entity employee to receive a request for a random reward from an organizer.

In general, gaming server 202, gaming machines 100 and gaming kiosk 204 are present within a gaming location. In various embodiments, one or more of gaming server 202, gaming machines 100 and/or gaming kiosk 204 may be spread across multiple gaming locations. In at least one embodiment, gaming machines 100 may be disposed at one or more locations, other than a casino, such as bars, gas stations, etc.

In the exemplary embodiment, gaming system 200 also includes a network 210, to which gaming server 202 is connected. Network 210 may include, without limitation, Internet, Intranet, a local area network (LAN), a cellular network, a wide area network (WAN), etc. It should be appreciated that gaming server 202 includes suitable security software to protect the integrity of gaming server 202, gaming machines 100 and/or any gaming activity associated with gaming server 202 and/or gaming machines 100. As shown in FIG. 3, gaming system 200 includes a social network server 212 coupled to network 210. Social network server 212 may be any server hosting one or more social networking websites, such as, without limitation, Twitter, Facebook, MySpace, Blogster, LinkedIn, Orkut, Friendster, etc. As such, gaming server 202 is able to communicate with a social network website, hosted by social network server 212, through network 210.

Additionally, gaming system 200 includes a computer 214, a laptop 216, and a smartphone 218 for coupling network 210 and often located away from a gaming location (e.g., gaming server 202 and gaming machines 100), and therefore also coupling to gaming server 202 and social network server 212.

Figure 4:
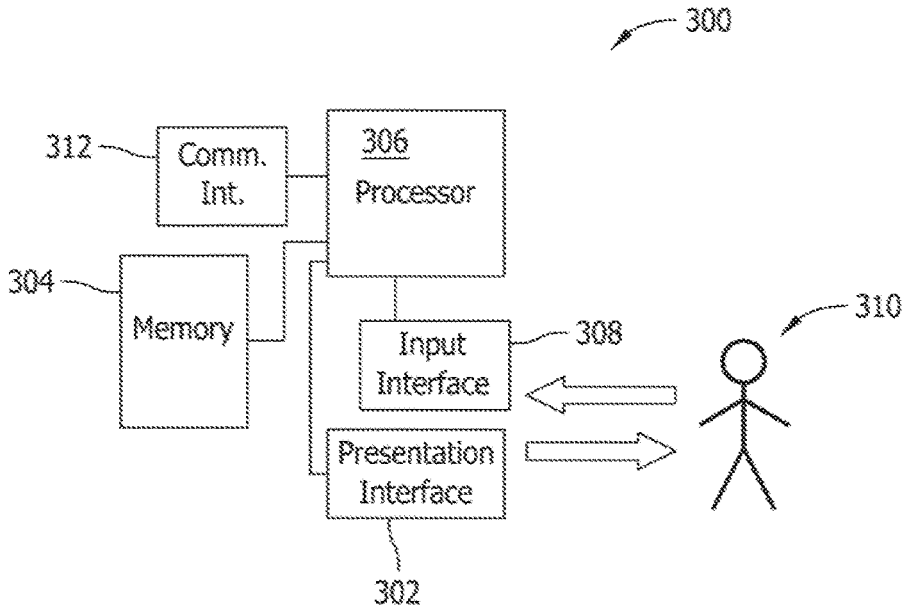
FIG. 4 is a block diagram of an exemplary computing device.

FIG. 4 illustrates an exemplary computing device 300. Each of gaming server 202, gaming kiosk 204, gaming workstation 208, social network server 212, computer 214, laptop 216, and smartphone 218 are examples of computing devices 300. Computing device 300 includes a presentation device 302, a memory device 304 and a processor 306 in communication with presentation device 302 and memory device 304. Presentation device 302 may include, without limitation, a cathode ray tube (CRT) display, a liquid crystal display (LCD), an organic light emitting diode (OLED) display, or other suitable device for use in presenting information to a user.

Memory device 304 is any suitable device that may be used for storing and/or retrieving information, such as executable instructions and/or data, and is general consistent with memory device 106 described above. Processor 306 may include one or more processing units and may be programmed to perform alone or in combination with any of the processes, methods or functions described with respect to gaming system 200.

Computing device 300 includes an input device 308 for receiving input from user 310, such as a system administrator, IT professional, a gaming player, a social network user, etc. Input device 308 may include, without limitation, a keyboard, a pointing device, a mouse, a stylus, a touch sensitive panel (e.g., a touch pad or a touch screen), a gyroscope, an accelerometer, a position detector, and/or an audio input device. A single component, such as a touch screen, may function as both presentation device 302 and input device 308. Further, computing device 300 includes a communication interface 312, to provide communication between computing device 300 and another computing device 300 and/or one or more networks, including, for example, network 210.

Referring again to FIG. 3, gaming system 200 is usable to create a random reward. As used herein, the term random reward refers to a secondary game hosted by a gaming entity, at gaming server 202, which pays an award, once at least one predetermined condition is satisfied. A random reward may include, for example, a mystery jackpot, which is guaranteed to pay, when one of plurality of gaming machines 100 pushing a running total associated with the mystery jackpot over a trigger amount set between a minimum and a maximum amount (i.e., a predetermined condition). In the exemplary embodiment, gaming server 202 receives a request for a random reward from an organizer of the random reward. The organizer may be, for example, a player, a business, or a gaming entity, such as the casino. In one example, a player may request a random reward to be played with a group of social network friends. In another example, a business may request a random reward as a form of advertisement for the business, in order to enhanced exposure of a brand offered by the business. In yet another example, an gaming entity, such as an administrator of gaming system 200, may submit a request for a random reward to gaming server 202 in order to increase the volume of gaming activities and/or enhanced entertainment value associated with primary gambling activities. Additionally, or alternatively, a gaming entity may offer a random reward to a player, who subsequently submits and/or provides a request for a random reward to gaming server 202.

The request for the random reward may be received by gaming server 202 is a variety of manners. In one example, the request for the random reward may be submitted through a web site associated with and/or hosted by gaming server 202, such as a gaming entity's website. In such an example, the request for the random reward would be received at gaming server 202 from computer 214, laptop 216, smartphone 218 or other computing device 300. In this example, the request for the random reward is submitted and received through network 210. In other examples, the request for the random reward may be received from gaming machine 100, gaming kiosk 204 or other machine at a gaming location. In yet another example, the request may be received, at gaming server 202, from computer 214 operated by an employee of the gaming entity, who enters the request provided from a player or a business in-person or via telephone, email, text message, etc. In such an example, the request for a random reward may be received at the gaming server 202, potentially in response to the gaming entity's invitation to the organizer to request a random reward.

The request for the random reward may include various types of information about the player, the gaming entity, the business, etc. Specifically, for example, the request for the random reward from a player may include, without limitation, player contact information, a player's rewards account, a list of invitees to the random reward, contact information for one or more of the invitees, eligibility requirements for the random reward, etc. In at least one embodiment, contact information in the request may include an identification of a social network and a social network identifier. In such an embodiment, the organizer may enter social network identifier or, more preferably, grant gaming server 202 access to the one or more groups of organizer's friends. The request may include information of the random reward, such as, without limitation, a selection of a random reward payout, a pledged amount of gaming activities per time period, a duration of the random reward, payout instructions for dividing the random reward payout, evenly or unevenly, among the players of random reward, etc.

Upon receiving the request for the random reward, processor 304 of gaming server 202 establishes the random reward according to one or more parameters. The parameters may be based on information within the request from the organizer and/or set by the gaming entity who administers the random reward. Parameters may include, without limitation, a random reward payout amount, a random reward payout type, the rate of credit applied to the random reward, the duration of the random reward, a number of invited players, a schedule for crediting the random reward based on the amount of gaming activity, the frequency of gaming activity, and/or the amount of coin bet during the gaming activity, etc. In various embodiments, the gaming entity may limit the random reward based on various criteria related to the information contained in the request. For example, a player's rewards account status with the administrator of gaming system 200 may suggest the payout associated with the random reward. Specifically, for example, a "gold" rewards level player may be eligible for a $5,000 random reward, while a "silver" rewards level player may only be eligible for a $2,500 random reward.

It should be appreciated that any number of factors related to players, the players' gaming activities, the gaming entity, the random reward, or other factors may be used to determine the parameters of the random reward.

After the random reward has been established, processor 304 of gaming server 202 transmits a credential associated with the random reward to at least one player. In the exemplary embodiment, gaming server 202 may transmit the credential to multiple players, including the organizer of the random reward, via network 210, gaming machine 100, gaming kiosk 204, and/or gaming workstation 208, etc. Subsequently, the credential may be presented by the player to gaming system 200, which causes processor 304 of gaming server 202 to credit the player's gaming activity to the random reward. The player may be, for example, the organizer, an invitee of the organizer, and/or another player designated by the organizer or an invitee.

In the exemplary embodiment, the credential may be provided to the participant through a variety of methods, which may be facilitated by one or more of the organizer, gaming server 202, and an invitee of the organizer, etc. In one example, gaming server 202 transmits the credential to gaming kiosk, which, in turn, prints one or more coupons including the credential. Organizer is then able to distribute the coupons to a plurality of invitees to encourage the invitee to participate in the random reward.

In another example, the request for a random reward received by gaming server 202 may include contact information for one or more invitees. Specifically, for example, the organizer may include social network identifiers for each of a plurality of invitees to the random reward. After the random reward is established, gaming server 202 may communicate with social network server 212 to deliver invitations including a credential to each of the invitees, via the social network identifier. In yet another example, the request for the random reward may include other contact information, such as phone numbers, email addresses, mailing address, rewards accounts, etc., which permits gaming server 202 to transmit (directly or indirectly) an invitation to each of the invitees. In one example, gaming server 202 may facilitate transmission of one or more SMS messages to a plurality of invitees. In another example, gaming server 202 may transmit an email to each of the invitees included in the organizer's request for a random reward. The emails and/or SMS messages may be specific to the invitee or generic to invitees of the random reward.

In various embodiments, the credential may be specific to the random reward, specific to an organizer, specific to an invitee, and/or specific to any other characteristic of a player, etc. In one example, the credential is merely specific to the random reward, such that any player who presents the credential to gaming machine 100 permits gaming server 202 to credit the player's gaming activity to the random reward. Alternatively, the credential may be specific to a player, such that each player of a random reward is provided a credential that is linked to the random reward, yet specific to the player. In such an embodiment, gaming activity associated with each player may be individually tracked, by gaming server 202, to provide data related to which individual players are advancing the random reward toward the random reward's trigger and by how much.

Furthermore, the credentials may indicate an authority level relative to the random reward. For example, a credential associated with an organizer may provide authority to send invitations to additional invitees, remove one or more players from a random reward, approve/disapprove invitees of other invitees, set eligibility requirements, and/or make alterations/additions to the random reward payout amount and/or type, etc. In one example, a player with organizer credential may be permitted to re-adjust the payout instructions of the random reward to more closely represent the amount of gaming activity contributed by each player. In yet another embodiment, a player with an organizer credential may revoke a credential associated with a player who has failed to meet minimum eligibility requirements. It should be appreciated that various levels of authority may be provided through credentials to various types of players. For example, in at least one embodiment, an invitee credential may permit the invitee to invite subordinate invitees to share in their portion of the random reward or the random reward as a whole. In such an example, the invitee credential would provide authority over subordinate invitees similar to the organizer's authority over the random reward. As should be apparent, numerous possible combinations and/or permutation of hierarchy and/or authority between the players may be provided in various other embodiments.

In this exemplary embodiment, once a player possesses a credential, the player is permitted to present the credential to a gaming machine 100 to initiate gaming activity, which is credited to the random reward. In turn, gaming server 202 receives the credential from gaming machine 100 and credits gaming activity at gaming machine 100 to the random reward. In various embodiments, when a credential is initially presented to gaming machine 100, gaming server 202 may prompt gaming machine 100 to request additional information. For example, when an invitee initially presents a credential as a printed coupon, gaming server 202 may request identifying information from the player, such as name, contact information, reward number, player preferences, etc. Additionally, when an invitee presents a credential through use of a social network username, gaming server 202 may also request such identifying information from the player. After the identifying information is received, gaming server 202 stores the identifying information in memory device 304. The identifying information may be used, as described below, to provide updates on the random reward to the players and/or provide one or more other promotional offers to the player from a gaming entity administering and/or associated with the random reward, including, for example, a casino or a manufacturing of one or more of gaming machines 100.

In various embodiments, an organizer of the random reward may be able to approve/disapprove of a player presenting credential associated with the random reward. In such an embodiment, gaming server 202 may receive a credential from a player (for example, from gaming machine 100) and transmit a message (e.g., an email, an SMS message, a social network message, etc.) to the organizer through a gaming machine 100, gaming kiosk 204, and/or network 210. Gaming server 202 may restrict access to the random reward until the organizer has provided approval for the player. In at least one embodiment, gaming server 202 causes pending requests to join a random reward to be displayed to the organizer at gaming machine 100, gaming kiosk 204, computer 214, laptop 216, smartphone 218 and/or a social network website, etc. In such an embodiment, the pending requests to join may be automatically and/or periodically transmitted to the organizer when the organizer initiates gaming activity. In still other embodiments, approval to participate in the random reward may be automatic by presentation of the credential.

In one embodiment, a player may present the credential to gaming server 202 through gaming kiosk 204, social network server 212, computer 214, laptop 216, or smartphone 218 to provide identifying information. Additionally, or alternatively, a player may present a credential to an employee operating gaming workstation 208, which may solicit identifying information from the player and enter such information to gaming server 202, through gaming workstation 206. In at least one alternate embodiment, gaming server 202 may permit a player to present a credential to gaming machine 100 and attribute gaming activity to the random reward without providing any additional identifying information.

In several embodiments, a player may be associated with several random rewards, such that the player may be prompted to select one of the random rewards to be credited. Alternatively, the player may select multiple random rewards, such that a portion of the player's gaming activity is credited, by processor 304 of gaming server 202, to each of the multiple random rewards. In some embodiments, a player associated with a random reward may request a secret random reward or nested group within a random reward, in which gaming activity from multiple players is credited to the random reward on behalf of the organizer of the secret random reward. The secret random reward may be set up, such that each player associated with the secret random reward may share in the player's portion of the random reward. The secret random reward may be secret from or known to one or more other players associated with the random reward. In at least one embodiment, an organizer of a random reward may disallow secret random rewards.

After presenting the credential and/or providing identifying information, gaming server 202 credits the player's gaming activity to the random reward to advance the random reward toward its trigger. As the random reward is credited with gaming activity, gaming server 202 may provide status messages to players through gaming machines 100, gaming kiosk 204, computer 214, laptop 216, smartphone 218 and/or a social network website, etc. The status messages may be presented to the player in the form of a visual graphic on random reward status display 120 (as shown in FIG. 2), such as a thermometer, a temperature gage, melting ice, or another graphic sufficient to indicate the progress and/or percentage of completion toward the trigger of the random reward. In another embodiment, the status message may be displayed on local presentation device 206, without an identifier of the random reward. In various embodiments, a player may be able to indicate to gaming server 202 the frequency, manner, method, and/or timing of status messages related to the random reward. Further, in some embodiments, the random reward status display may be used to provide one or more promotional offers to players associated with a random reward.

In several embodiments, gaming server 202 may transmit a message to gaming machine 100, gaming kiosk 204, social network server 212, computer 214, laptop 216, or smartphone 218, indicating the status of one or more other players. Specifically, for example, gaming server 202 may detect the credential of a player at gaming machine 100 and transmit a message to one or more other players within a gaming location, indicating the presences of the player. Additionally, or alternatively, when a player presents a credential to gaming machine 100 or gaming kiosk 204, gaming server 202 may cause the status of other player associated with the random reward to be displayed to the player. Further, the status of a player may be transmitted by gaming server 202 to one or more other players, via a social network website. In various embodiments, gaming server 202 may receive one or more settings from a player to limit information available to other players of the random reward. For example, a player may be permitted to omit his/her status (e.g., presence within a casino, frequency of gaming activity, volume of gaming activity, etc.) from other players of the random reward.

Furthermore, messages transmitted by gaming server 202 to one or more players may include a total activity attributed to the random reward, a status relative to a trigger maximum and/or minimum, a listing of players and relative gaming activity attributed to the random reward (e.g., on a daily basis, a weekly basis, a monthly basis, and/or other time basis), current location of other players, a leader board of gaming activity attributed to the random reward, a temporal total of gaming activity relative to a requirement, etc. Similar to the above example, a player may be permitted to opt out of one or more statuses in various gaming system embodiments.

As gaming server 202 continues to credit gaming activity toward the random reward, one or more players of the random reward may request and/or implement one or more changes to the random reward. In some embodiments, however, the players contributing to the random reward may be made static after a predetermined amount of progress toward the trigger is made, such as, for example, about 30%, 50% or 80%, etc. In such embodiments, an organizer and/or an invitee would not be able to eliminate one or more players, who have access to the random reward when the progress toward the random reward crosses the predetermined amount. As such, the possibility of eliminating a player (who has contributed to a random reward) from the random reward payout is reduced. At the same time, the pool of players eligible for the random reward payout would not be diluted by adding an additional player after the predetermined amount, just prior to triggering the random reward payout, thereby diluting a shared random reward payment. It should be appreciated that various rules and limitation may be implemented, in some embodiments, by a gaming entity, an organizer and/or an invitee to increase participation in the random reward and/or enable a fair, balance, and/or desired random reward payout occurs.

In the exemplary embodiment, different types of gaming activity by a player may be credited differently, by gaming server 202, toward triggering the random reward. In one embodiment, gaming server 202 may credit more gaming activity toward the random reward for a high bet and/or certain types of games. Specifically, for example, gaming server 202 may credit 50 chances to trigger a random reward when a player bets $5 per game, while crediting 200 chances to trigger the random reward when the player is betting $10 per game. The number of chances credited to the random reward by gaming server 202 may have one or more linear and non-linear relationships to the amount of a bet, the type of game played, the number of consecutive games, the types of gaming machine 100, the rewards account status, etc.

The random reward may be triggered by a player exceeding the random trigger amount assigned to the random reward, by hitting a random reward combination of symbols at gaming machine 100, or other suitable triggers. When the random reward is triggered, the payout is awarded according to the payout instructions, as included in the original request and/or as modified by one or more of the organizer, an invitee, or the gaming entity hosting the random reward. In one embodiment, when the random reward is triggered, the random reward payout includes a straight monetary award paid to the player who triggers the random reward payout. In another embodiment, the random reward payment may include bonus feature rounds, win multipliers, or free-spins for the player who triggers the random reward and/or all players associated with the random reward. In at least one embodiment, the random reward payout may be multiplied by the player's bet when the player triggered the random reward. Additionally, or alternatively, the random reward payout may be determined by the rewards account of the player triggering the random reward and/or the rewards accounts of some or all players associated with the random reward. The random reward payout may be determined and/or modified, by gaming server 202, when the random reward is established, when the random reward is triggered, and/or at some point therebetween.

In various embodiments, the random reward payout may be incremented and/or decremented during the pendency of the random reward based on the amount of gaming activity credited to the random reward by one or more players. In one embodiment, gaming server 202 may adjust each player's share of the random reward award, as indicated in the payout instructions, during the pendency of the random reward, or according to the individual player's gaming activity credited to the random reward.

The random reward payout may be limited to the player that triggers the random reward or may be distributed to one or more players of the random reward. In some embodiments, the random reward payout may be divided equally amongst players associated with the random reward. In another embodiment, the random reward payout may be divided according to a percentage of the total gaming activity attracted to each player. In yet another embodiment, the random reward payout may be distributed to the players according to a player-specified payout instructions for the random reward. As should be apparent, there are numerous ways the random reward payout may be distributed amongst the players associated with the random reward. The payout distribution may be the product of the settings and/or instructions of the organizer, the invitees, and/or the gaming entity administering the random reward.

In the exemplary embodiment, when the random reward is triggered, gaming server 202 transmits one or more messages to players associated with the random reward. The message may include a description of the random reward payout and the distribution instructions, as well as, when applicable, instructions for the player on how to redeem the random reward payout.

In at least one embodiment, when a random reward is triggered, gaming server 202 may transmit let-it-ride messages to each player associated with the random reward. In such an embodiment, the players may opt (e.g., by voting) to take the let-it-ride option and bet the random reward payout in connection with one or more games hosted by the gaming entity. Players may select the let-it-ride option individually or as a group. Alternatively, in one or more embodiments, the let-it-ride option upon triggering the random reward may be omitted.

Figure 5:
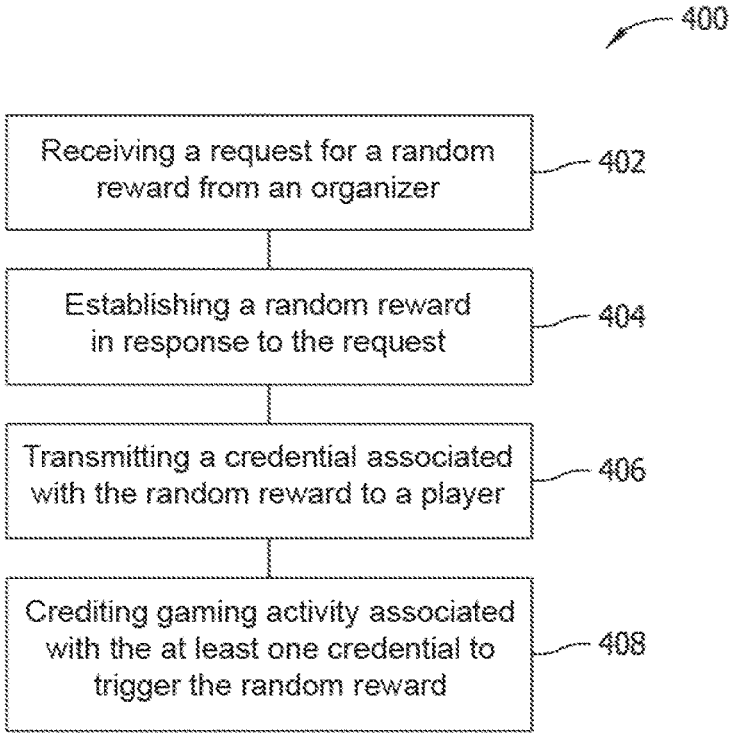
FIG. 5 is a block diagram of the exemplary methods for creating a random reward.

FIG. 5 illustrates an exemplary method 400 for use in creating a random reward. While method 400 is described with reference to gaming system 200, it should be understood that method 400 and/or other methods described herein are not limited to gaming system 200 and may be used with other gaming systems. Likewise, gaming system 200 should not be understood to be limited to method 400. Method 400 includes receiving 402 a request for a random reward from an organizer, establishing 404, at gaming server 202, a random reward in response to the request, transmitting 406, from gaming server 202, a credential associated with the random reward to a player, and crediting 408 gaming activity associated with the at least one credential to trigger the random reward. Access to the random reward is limited to players presenting the credential.

In some embodiments, method 400 includes tracking gaming activity credited to the random reward by each of a plurality of players. Additionally, or alternatively, method 400 may include transmitting, from gaming server 202, a status of the random reward to be displayed by gaming machine 100 when gaming activity is credited to the random reward. In at least one embodiment, method 400 may include transmitting the credential to a player designated by a player other than the organizer.

Exemplary embodiments of systems and methods for creating random rewards are described herein. The systems and methods described herein may provide an enhanced gaming experience, where a player is able to create a limited-access random reward, as compared to several known jackpots with unlimited access. The random reward may be limited to players selected by the organizers and/or additional player invited by players. The systems and methods described herein may utilize one or more social networks to disseminate invitations to random rewards and/or provides status message related to random reward, which are features unavailable in known gaming activities. Furthermore, unlike known jackpots, the systems and methods described herein may provide players of a random reward control over parameters of the random reward.

The systems and methods are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of non-transitory computer readable media. By way of example and not limitation, computer readable media includes, for example, a non-transitory computer storage device. Computer storage media include volatile and nonvolatile, removable and non-removable media implemented in any method or technology for storage of information such as computer readable instructions, data structures, program modules, or other data in a device.

Although the present disclosure is described in connection with an exemplary gaming system environment, embodiments of the invention are operational with numerous other general purpose or special purpose gaming system environments or configurations. The gaming system environment is not intended to suggest any limitation as to the scope of use or functionality of any aspect described herein. Moreover, the gaming system environment should not be interpreted as having any dependency or requirement relating to any one or combination of components illustrated in the exemplary operating environment.

Embodiments of the invention may be described in the general context of computer-executable instructions, such as program components or modules, executed by one or more computers or other devices. Aspects described herein may be implemented with any number and organization of components or modules. For example, aspects of the invention are not limited to the specific computer-executable instructions or the specific components or modules illustrated in the figures and described herein. Alternative embodiments of the invention may include different computer-executable instructions or components having more or less functionality than illustrated and described herein.

The order of execution or performance of the operations in the embodiments illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

When introducing elements of aspects of the invention or embodiments thereof, the articles "a," "an," "the," and "said" are intended to mean that there are one or more of the elements. The terms "comprising," "including," and "having" are intended to be inclusive and mean that there may be additional elements other than the listed elements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of creating a random reward that is accessible to a group of players, said method comprising:

receiving, from a first player, a request to initiate a casino-based game on a gaming machine, the request received through at least one of the gaming machine, a website associated with or hosted by a gaming server communicatively coupled to the gaming machine, a gaming kiosk, and another gaming-related machine at a gaming location;

initiating play of the game by the first player on the gaming machine by receiving a wager using at least one of a coin acceptor configured to accept at least one of coins and tokens, and a paper acceptor configured to at least one of accept and validate at least one of cash bills, coupons, tickets, identification cards, reward cards, smart cards, and vouchers;

receiving a request for the random reward from an organizer of the random reward;

establishing, by a processor in a gaming server, the random reward in response to the request;

transmitting, from the processor in the gaming server, an invitation including a player-specific credential associated with the random reward to at least one invitee through a social network website, wherein access to the random reward is limited to the at least one invitee redeeming the credential, the player-specific credential specific to each respective invitee, such that each respective invitee of a random reward is provided a credential that is linked to the random reward and specific to that invitee;

receiving an indication of each credential redeemed by the at least one invitee at a second gaming machine, where the at least one invitee becomes a player;

crediting gaming activity of each player associated with the redeemed credential to the random reward, wherein credited gaming activity is determined based on an amount wagered for each game played meeting one or more wager amount thresholds;

comparing the credited gaming activity of each player associated with the credential to a predetermined gaming activity threshold for achieving the random reward; and displaying, on the second gaming machine, an indicator of the comparison of the credited gaming activity and the predetermined threshold.

2. The method of claim 1, wherein receiving the request for the random reward includes receiving the request including identifying information for a plurality of invitees; and wherein transmitting the player-specific credential to each player in the group of players includes transmitting the credential to each of the plurality of invitees based on the identifying information.

3. The method of claim 1, wherein receiving the request for the random reward includes receiving a request including a social network identifier; and wherein transmitting the credential associated with the random reward to each player in the group of players includes transmitting the credential to each of a plurality of invitees through the social network website based on the social network identifier.

4. The method of claim 1, further comprising, when the random reward is triggered, awarding a prize associated with the random reward to at least one player in the group of players based on a total gaming activity credited to the random reward and the credited gaming activity directly attributed to said at least one player.

5. The method of claim 1, wherein receiving the request for the random reward includes receiving the request including identifying information for a plurality of invitees, and wherein the identifying information includes at least one of a name, a mailing address, an email address, a social network identifier, a user identifier, and a rewards account number.

6. The method of claim 1, further comprising transmitting, from the gaming server, a status of the random reward to be displayed by the gaming machine when gaming activity on the gaming machine is credited to the random reward.

7. The method of claim 1, further comprising transmitting, from the gaming server, a status of the random reward to the first player, via at least one of a social network server and a wide area network (WAN).

8. The method of claim 1, further comprising setting a parameter of the random reward based on the request received from the organizer, the parameter including at least one of a random reward payout amount, an eligibility requirement, a target amount of gaming activities per time period, and a duration of the random reward.

9. The method of claim 1, wherein transmitting a credential associated with the random reward to each player in the group of players comprises transmitting a credential associated with the random reward to players that are designated by the first player, wherein the first player is not the organizer.

10. The method of claim 1 further comprising awarding the random reward to a player associated with the credential when the credited gaming activity exceeds the predetermined threshold.

11. The method of claim 1, wherein the credited gaming activity includes chances to win, and wherein the method further comprises:

awarding a first amount of chances to win the random reward based on the amount wagered exceeding a first threshold; and awarding a second amount of chances to win the random reward based on the amount wagered exceeding a second threshold, wherein the second amount is greater than the first amount, and wherein the second threshold is greater than the first threshold.

12. A gaming system comprising:

a gaming machine configured to:

receive a wager using at least one of a coin acceptor configured to accept at least one of coins and tokens, and a paper acceptor configured to at least one of accept and validate at least one of cash bills, coupons, tickets, identification cards, reward cards, smart cards, and vouchers; and a gaming server coupled to said gaming machine, said gaming server configured to:

receive, from a first player, a request to initiate a casino-based game on a gaming machine, the request received through at least one of the gaming machine, a website associated with or hosted by a gaming server communicatively coupled to the gaming machine, a gaming kiosk, and another gaming-related machine at a gaming location;

during play of the game by the first player on the gaming machine, receive a request for a random reward from an organizer;

establish, at said gaming server, the random reward in response to the request;

transmit, from said gaming server, an invitation including a player-specific credential associated with the random reward to at least one invitee through a social network website, wherein access to the random reward is limited to the at least one invitee redeeming the credential, the player-specific credential specific to each respective invitee, such that each respective invitee of a random reward is provided a credential that is linked to the random reward and specific to that invitee;

receive an indication of each credential redeemed by the at least one invitee at a second gaming machine, where the at least one invitee becomes a player;

credit gaming activity on said gaming machine and associated with the credential to the random reward, wherein credited gaming activity is determined based on an amount wagered for each game played meeting one or more wager amount thresholds;

compare the credited gaming activity of each player associated with the credential to a predetermined gaming activity threshold for achieving the random reward; and display, on the second gaming machine, an indicator of the comparison of the credited gaming activity and the predetermined threshold.

13. The gaming system of claim 12, wherein said gaming server is configured to track gaming activity associated with each player credited to the random reward.

14. The gaming system of claim 12, wherein said gaming server is further configured to distribute a payout associated with the random reward according to at least one payout instruction received from at least one of the organizer and at least one invitee of the organizer.

15. The gaming system of claim 12, further comprising a local presentation device coupled to said gaming server and configured to receive a status message associated with the random reward from said gaming server and to display the status message to at least one player.

16. The gaming system of claim 12, wherein the request includes identifying information for one or more additional players, and wherein said gaming server is configured to transmit the credential associated with the random reward to the one or more additional players based on the identifying information.

17. The gaming system of claim 12, wherein said gaming server is further configured to award the random reward to a player associated with the credential when the credited gaming activity exceeds the predetermined threshold.

18. A gaming server communicatively coupled to a plurality of gaming machines, said gaming server for use in creating a random reward accessible to a group of players operating respective gaming machines, said gaming server comprising:

a memory device configured to store multiple credentials associated with the random reward; and a processor coupled to said memory device, said processor configured to:

receive, from a first player of the group of players, a wager using a credit input mechanism including at least one of a coin acceptor configured to accept at least one of coins and tokens, and a paper acceptor configured to at least one of accept and validate at least one of cash bills, coupons, tickets, identification cards, reward cards, smart cards, and vouchers;

initiate a casino-based game on a gaming machine based at least in part on the received wager;

during play of the game by the first player on the gaming machine, establish the random reward in response to a request for the random reward from an organizer;

transmit a plurality of invitations, each invitation including respective player-specific credentials associated with the random reward from the memory device to at least one invitee through a social network website, the player-specific credential specific to each respective invitee, such that each respective invitee of a random reward is provided a credential that is linked to the random reward and specific to that invitee;

receive an indication of each of the multiple credentials redeemed by the at least one invitee at a second gaming machine, where the at least one invitee becomes a player;

permit access to the random reward only to the players in the group of players presenting one of the multiple credentials at a respective gaming machine;

control a random reward status display of at least one of said plurality of gaming machines to display a status of at least one of the random reward and one or more other players participating in the random reward;

credit gaming activity to the random reward when at least one of the multiple credentials is associated with the gaming activity, wherein credited gaming activity is determined based on an amount wagered for each game played meeting one or more wager amount thresholds;

compare the credited gaming activity of each player associated with the credential to a predetermined gaming activity threshold for achieving the random reward; and display, on the second gaming machine, an indicator of the comparison of the credited gaming activity and the predetermined threshold.

19. The gaming server of claim 18, wherein said processor is configured to transmit the multiple credentials associated with the random reward to the group of players based on a social network identifier associated with each player in the group of players.

20. The gaming server of claim 18, wherein said processor is further configured to store a status of the random reward in said memory device and to cause the status of the random reward to be broadcast to the gaming machine, a display signage, a desktop computer, a tablet, a smartphone, and a laptop.

21. The gaming server of claim 18, wherein the gaming activity is directed to gaming machines disposed at a gaming location.

22. The gaming server of claim 18, wherein the gaming activity is directed to at least one of a desktop computer, a smartphone, a tablet, and a laptop.

23. The gaming server of claim 18, wherein said processor is configured to award the random reward to a player associated with the credential when the credited gaming activity exceeds the predetermined threshold.

24. One or more non-transitory computer-readable storage media having computer-executable instructions embodied thereon, wherein when executed by at least one processor, said computer-executable instructions cause the processor to:

receive, from a first player, a wager through a credit input mechanism associated with at least one of a gaming machine, a website associated with or hosted by a gaming server communicatively coupled to the gaming machine, a gaming kiosk, and another gaming-related machine at a gaming location, the credit input mechanism including at least one of a coin acceptor configured to accept at least one of coins and tokens, and a paper acceptor configured to at least one of accept and validate at least one of cash bills, coupons, tickets, identification cards, reward cards, smart cards, and vouchers;

receive a request to initiate a casino-based game on a gaming machine based at least in part on the received wager;

during play of the game by the first player, receive a request for a random reward from an organizer;

establish the random reward in response to the request for the gaming machine that receives a wager using a credit input mechanism;

transmit an invitation including a player-specific credential associated with the random reward to at least one invitee through a social network website, wherein access to the random reward is limited to the at least one invitee redeeming the player-specific credential using a paper acceptor, the player-specific credential specific to each respective invitee, such that each respective invitee of a random reward is provided a credential that is linked to the random reward and specific to that invitee;

receiving an indication of each credential being redeemed by the at least one invitee at a second gaming machine, where the at least one invitee becomes a player;

credit gaming activity associated with the player-specific credential to the random reward, wherein credited gaming activity is determined based on an amount wagered for each game played meeting one or more wager amount thresholds;

compare the credited gaming activity of each player associated with the credential to a predetermined gaming activity threshold for achieving the random reward; and display, on the second gaming machine, an indicator of the comparison of the credited gaming activity and the predetermined threshold.

25. The one or more non-transitory computer-readable storage media of claim 24, wherein said computer-executable instructions further cause the processor to individually track gaming activity of each player credited to the random reward.

26. The one or more non-transitory computer-readable storage media of claim 24, wherein said computer-executable instructions further cause the processor to transmit the credential to each player, via a social network server.

* * * * *